US008096421B2

(12) United States Patent
Shinoda

(10) Patent No.: US 8,096,421 B2
(45) Date of Patent: Jan. 17, 2012

(54) MICRO-FLUIDIC CHIP, MICRO-PARTICLE SORTING DEVICE AND FLOW CONTROLLING METHOD

(75) Inventor: Masataka Shinoda, Tokyo (JP)

(73) Assignee: Sony Corporation, Tokyo (JP)

( * ) Notice: Subject to any disclaimer, the term of this patent is extended or adjusted under 35 U.S.C. 154(b) by 163 days.

(21) Appl. No.: 12/536,038

(22) Filed: Aug. 5, 2009

(65) Prior Publication Data

US 2010/0032349 A1 Feb. 11, 2010

(30) Foreign Application Priority Data

Aug. 8, 2008 (JP) ..... 2008-205375

(51) Int. Cl.
*B07C 5/00* (2006.01)

(52) U.S. Cl. ..... 209/44.2; 209/552; 209/644; 209/932

(58) Field of Classification Search ..... 209/3.1, 209/44.2, 552, 644, 906, 932
See application file for complete search history.

(56) References Cited

U.S. PATENT DOCUMENTS

| | | | | |
|---|---|---|---|---|
| 3,827,555 | A | 8/1974 | Kamentsky et al. | |
| 6,400,453 | B1 | 6/2002 | Hansen | |
| 6,497,252 | B1 | 12/2002 | Kohler et al. | |
| 7,392,908 | B2 * | 7/2008 | Frazier | 209/3.1 |
| 7,595,195 | B2 * | 9/2009 | Lee et al. | 436/52 |
| 7,746,466 | B2 * | 6/2010 | Godin et al. | 356/246 |
| 7,987,022 | B2 * | 7/2011 | Handique et al. | 700/266 |
| 2002/0033939 | A1 | 3/2002 | Hansen | |
| 2003/0209059 | A1 | 11/2003 | Kawano et al. | |
| 2005/0172476 | A1 * | 8/2005 | Stone et al. | 29/592.1 |
| 2006/0073076 | A1 | 4/2006 | Ichiki et al. | |
| 2006/0177348 | A1 | 8/2006 | Yasuda et al. | |
| 2007/0054119 | A1 * | 3/2007 | Garstecki et al. | 428/402 |
| 2008/0003678 | A1 | 1/2008 | Hattori | |
| 2008/0213821 | A1 * | 9/2008 | Liu et al. | 435/39 |
| 2009/0005254 | A1 * | 1/2009 | Griffiths et al. | 506/7 |
| 2009/0197248 | A1 * | 8/2009 | Griffiths et al. | 435/6 |
| 2009/0215154 | A1 * | 8/2009 | Ganan Calvo et al. | 435/252.33 |
| 2009/0308473 | A1 * | 12/2009 | Shinoda | 137/827 |
| 2011/0030808 | A1 * | 2/2011 | Chiou et al. | 137/13 |
| 2011/0089328 | A1 * | 4/2011 | Li | 250/364 |
| 2011/0114190 | A1 * | 5/2011 | Wen et al. | 137/1 |

FOREIGN PATENT DOCUMENTS

| | | |
|---|---|---|
| JP | 06109617 | 4/1994 |
| JP | 2002-523709 | 7/2002 |
| JP | 2002-523738 | 7/2002 |
| JP | 2003-107099 | 4/2003 |
| JP | 2003-344260 | 12/2003 |
| JP | 2004-000144 | 1/2004 |
| JP | 2004-085323 | 3/2004 |
| JP | 2005-300398 | 10/2005 |
| JP | 2006-220423 | 8/2006 |
| WO | 03008937 | 1/2003 |
| WO | 03088733 | 10/2003 |

OTHER PUBLICATIONS

Japanese Office Action issued on Dec. 7, 2010, for corresponding Japanese Appl. No. 2008-205375. Japanese Office Action for corresponding JP2008-205375 issued on May 25, 2010.
European Search Report (09010007.4) dated Oct. 12, 2009.

* cited by examiner

*Primary Examiner* — Joseph C Rodriguez
(74) *Attorney, Agent, or Firm* — K&L Gates LLP

(57) ABSTRACT

A micro-fluidic chip including a channel through which a liquid containing micro-particles flows, and a gas jetting section configured to jet a gas toward the micro-particle-containing liquid ejected from the channel is provided.

8 Claims, 4 Drawing Sheets

MICRO-FLUIDIC CHIP, MICRO-PARTICLE SORTING DEVICE AND FLOW CONTROLLING METHOD

CROSS REFERENCES TO RELATED APPLICATIONS

The present application claims priority to that disclosed in Japanese Priority Patent Application JP 2008-205375 filed In the Japan Patent Office on Aug. 8, 2008, the entire content of which is hereby incorporated by reference.

BACKGROUND

The present disclosure relates to a micro-fluidic chip for use in collection of micro-particles such as cells and micro-beads, a micro-particle sorting device on which the micro-fluidic chip is mounted, and a method of controlling a flow in the micro-fluidic chip. More particularly, the present disclosure relates to a technology for separating and collecting desired micro-particles from a solution in which a plurality of kinds of micro-particles are mixedly present.

In recent years, micro-fluidic chips have been developed in which fine channels and zones for chemical and biological analysis are fabricated in a substrate formed from an inorganic material such as silicon and glass or a polymer material such as plastic, by application of the micro-fabrication technology used in semiconductor industries. Such micro-fluidic chips enable measurement using small amounts of samples, can be manufactured at low cost, and are suited to disposable use. Therefore, these micro-fluidic chips have begun to be utilized in various fields, such as flow cytometry, electrochemical detectors in liquid chromatography, small electrochemical sensors in medicare sites, etc.

In addition, a technology for sorting and collecting micro-particles such as cells and micro-beads, based on the results of analysis in an analysis zone, has also been proposed (see Japanese Patent Laid-Open No. 2003-107099 as referred to as Patent Document 1 hereinafter. Japanese Patent Laid-Open No. 2006-220423 as referred to as Patent Document 2 hereinafter, Japanese Patent Laid-Open No. 2004-85323 as referred to as Patent Document 3 hereinafter, Japanese Patent Laid-Open No. 2003-344260 as referred to as Patent. Document 4 hereinafter). For example, in the micro-fluidic chip described in Patent Document 1, an alternating electric field is generated in the vicinity of an entrance to a sorting channel for sorting and collecting micro-particles, and the micro-particles are sorted by a repulsive dielectric migrating force. Besides, in a cell sorter chip described in Patent Document 2, a gel electrode having an electrolyte-containing gel is provided at such a position as to make contact with a liquid containing micro-particles, and the micro-particles are sorted by utilizing an electrophoretic force.

On the other hand, in a cell analyzing and separating apparatus described in Patent Document 3, micro-particles are separated by guiding them into predetermined branch channels through utilizing an ultrasound or an electrostatic force. Further, Patent Document 4 discloses a method of controlling the moving direction of micro-particles, wherein a branch channel the penetration of the micro-particles into which is to be inhibited is irradiated with laser light, and a shock wave is generated in a liquid.

However, the above-mentioned micro-fluidic chips according to the related art have the following problems. In the separating and collecting methods of the related art as described in Patent. Documents 1 to 4, the micro-particles are to be moved in a direction different from the direction of flow of the liquid containing the micro-particles, and, for this purpose, a strong active force has to be applied to the micro-particles. Therefore, the micro-particles to be collected are liable to be damaged. Particularly, where the micro-particles are biomaterial such as cells, the cells or the like to be collected may be killed.

In addition, in the method described in Patent Documents 1 to 4, the moving direction of micro-particles contained in a liquid flowing continuously in a channel is changed. Under the influence of this change in the moving direction, the flow on the upstream side is disturbed, whereby the accuracy of analysis and the accuracy of collection of the micro-particles are lowered. Further, where a method of controlling the moving direction of micro-particles by an electric field or a magnetic field is applied, the micro-fluidic chip is complicated in configuration.

Furthermore, in the "Jet in Air" system used in flow cytometry according to the related art, micro-particles such as cells are sorted and collected in the atmospheric air, so that an aerosol containing the micro-particles is liable to be generated. Therefore, there is a possibility of mutual contamination of the micro-particles, or the possibility of infection of the measuring operator with an infection disease due to the biohazard materials (micro-particles) contained in the aerosol.

Thus, there is a need for a micro-fluidic chip, a micro-particle sorting device and a flow controlling method which cause little damage to micro-particles and by which the moving direction of micro-particles in an enclosed micro-fluidic chip channel can be controlled speedily, accurately and safely.

SUMMARY

According to an embodiment, there is provided a micro-fluidic chip including: a channel through which a liquid containing micro-particles flows; and a gas jetting section configured to jet a gas toward the micro-particle-containing liquid ejected from the channel.

In this micro-fluidic chip, the gas is jetted toward the micro-particle-containing liquid from the gas jetting section, whereby the moving direction of the micro-particles can be accurately controlled while suppressing damage to the micro-particles.

In addition, the micro-fluidic chip may include a cavity zone into which droplets containing the micro-particles are introduced, and a plurality of branch zones communicating with the cavity zone. In this case, the moving direction of the droplets in the cavity zone can be changed by the gas, thereby guiding the droplets into an arbitrarily selected one of the branch zones.

Further, where a gas introducing section which joins the channel from at least one lateral side and through which a gas is introduced into the channel is provided, the liquid flowing in the channel can be split into droplets by the gas introduced through the gas introducing section.

Furthermore, the moving direction of the micro-particles can also be arbitrarily controlled by regulating the flow rate and/or pressure of the gas.

According to another embodiment, there is provided a micro-particle sorting device on which the above-mentioned micro-fluidic chip can be mounted.

In the micro-particle sorting device, the moving direction of micro-particles is controlled by a gas, so that damage to the micro-particles is little. In addition, the moving direction of the micro-particles can be controlled speedily, accurately and safely.

According to a further embodiment, there is provided a method of conducting a flow in a micro-fluidic chip, including the step of jetting a gas toward a liquid which contains micro-particles and which is flowing in a channel formed in a micro-fluidic chip, so as to control the moving direction of the micro-particles.

In the flow controlling method, the liquid containing the micro-particles may be split into droplets, on the basis of a predetermined number of the micro-particles.

Besides, the droplets containing the micro-particles may be guided, for collection, into an arbitrarily selected one of zones by the gas.

According to the present embodiment, the moving direction of micro-particles is controlled by blowing a gas, so that the moving direction of the micro-particles can be controlled speedily and accurately, while causing little damage to the micro-particles. In addition, the micro-particles can be sorted and collected in a closed space in the micro-fluidic chip. Therefore, there is no possibility of mutual contamination of the micro-particles, or infection of the measuring operator with an infection disease due to an aerosol or the like. Consequently, even where the micro-particles are bio-hazard materials, the intended operation can be carried out safely and hygienically.

Additional features and advantages are described herein, and will be apparent from the following Detailed Description and the figures.

DETAILED DESCRIPTION

Now, embodiments will be described in detail below, referring to the accompanying drawings.

Figure 1:
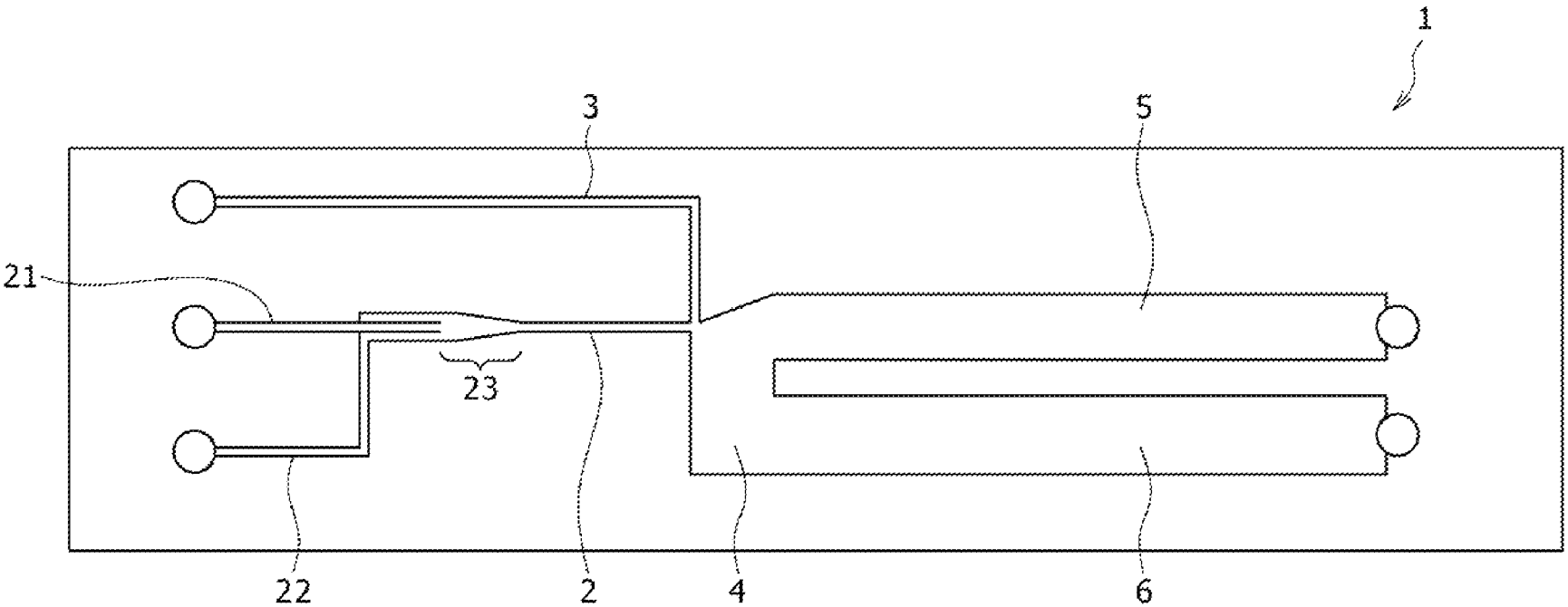
FIG. 1 is a plan view showing the configuration of a micro-fluidic chip according to a first embodiment.

First, a micro-fluidic chip according to a first embodiment will be described. FIG. 1 is a plan view showing schematically the configuration of the micro-fluidic chip according to the present embodiment. As shown in FIG. 1, the micro-fluidic chip 1 in this embodiment has a liquid channel 2 through which a liquid containing micro-particles flows, and a gas channel 3 through which a gas such as air or an inert gas, e.g., carbon dioxide or nitrogen flows.

On the upstream side of the liquid channel 2, there are formed a sample liquid introducing channel 21 through which a sample liquid with micro-particles dispersed therein is introduced, and a sheath liquid introducing channel 22 for introducing a sheath liquid therethrough. The sample liquid is enveloped with the sheath liquid so as to form a laminar flow, and the laminar flow in this state is let flow into the liquid channel 2. This ensures that the micro-particles in the sample liquid flows one after another in the state of being surrounded by the sheath flow, and the particles are aligned substantially in a row along the flowing direction.

Examples of the method for forming such a laminar flow include a method in which the sample liquid introducing channel 21 is composed of a micro-tube, and the sample liquid is introduced into a central portion of the sheath liquid flowing through the sheath liquid introducing channel 22. With the sample liquid introducing channel 21 and the sheath liquid introducing channel 22 configured in this manner, the laminar flow can be easily produced without need to form a complicated channel.

In addition, a narrow-down section 23 having a channel width gradually decreasing downstream may be provided at a position where the sample liquid introducing channel 21 and the sheath liquid introducing channel 22 join or on the downstream side of the joining position. Where the channel width is narrowed down on the downstream side of the joining position, the width of the sample liquid introducing channel 21 can be set to be sufficiently larger than the size of the micro-particles, so that clogging of the channel 21 with the micro-particles can be prevented from occurring. Further, where such a narrow-down section 23 is provided, the flow width in the condition where the sample liquid and the sheath liquid are forming the laminar flow can be regulated to an arbitrary size, so that it is also possible to enhance the accuracy of irradiation with measuring light.

Incidentally, the sample liquid introducing channel 21 and the sheath liquid introducing channel 22 are not limited to the configuration shown in FIG. 1, and various configurations can be applied, insofar as the above-mentioned laminar flow can be formed from the sample liquid and the sheath liquid.

On the other hand, a cavity (cavity zone) 4 is provided at the downstream end parts of the liquid channel 2 and the gas channel 3, and the liquid channel 2 and the gas channel 3 are so arranged that the flow directions of the liquid and the gas flowing respectively through them intersect in the cavity 4. Specifically, in the micro-fluidic chip 1 according to the present embodiment, the gas jetted from the gas channel 3 impinges on the micro-particle-containing liquid or droplets ejected from the liquid channel 2.

In addition, the inside of the cavity 4 is filled up with the gas jetted from the gas channel 3. The micro-particle-containing liquid having flowed through the liquid channel 2 is split into droplets upon flowing into the cavity 4, so that, in the cavity 4, the micro-particle-containing fluid moves in the state of the micro-particle-containing droplets. Thus, the gas is blown to the micro-particle-containing liquid or droplets at the terminal end of the liquid channel 2, whereby the influence of the gas jet on the flow on the upstream side in the liquid channel 2 can be suppressed. Incidentally, the surfaces of the cavity 4 are preferably finished to be water-repellent so that the droplet state is maintained in the cavity 4.

Further, a branch zone 5 and a branch zone 6 are provided in connection with the cavity 4. One of the branch zones 5 and 6 serves as a collected liquid reservoir section for reserving the micro-particles to be collected, while the other serves as a waste liquid reservoir section for reserving a waste liquid which contains the other micro-particles. The branch zones 5 and 6 may be so configured that, for example, as shown in FIG. 1, the branch zone 5 is formed coaxially with the flow direction of the liquid channel 2, and the branch zone 6 is formed at a position farther from, the terminal end (gas ejection port) of the gas channel 3 than the branch zone 5 is.

In this case, the moving direction of the micro-particle-containing droplets can be regulated by the presence/absence of the gas jet from the gas channel 3. Specifically, when it is desired to guide a droplet into the branch zone 5, the gas is not jetted to the droplet from the gas channel 3, and the gas is jetted only to the droplets which should be guided into the branch zone 6.

In addition, the branch zones 5 and 6 are desirably provided with a hole or aperture through which to take out the micro-particles and the liquid reserved inside, and with an exhaust port through which to release the gas jetted from the gas channel 3. The gas jetted from the gas channel 3 is exhausted through the exhaust port, whereby the pressure inside the cavity 4 can be prevented from rising.

Incidentally, examples of the material constituting the micro-fluidic chip 1 described above include polycarbonate, cycloolefin polymers, polypropylene, PDMS (polydimethylsiloxane), glass, and silicon. Among these materials, preferred are polymer materials such as polycarbonate, cycloolefin polymers, and polypropylene, in view of their excellent proccessability and their capability of being inexpensively duplicated by use of molding equipment.

Figure 2:
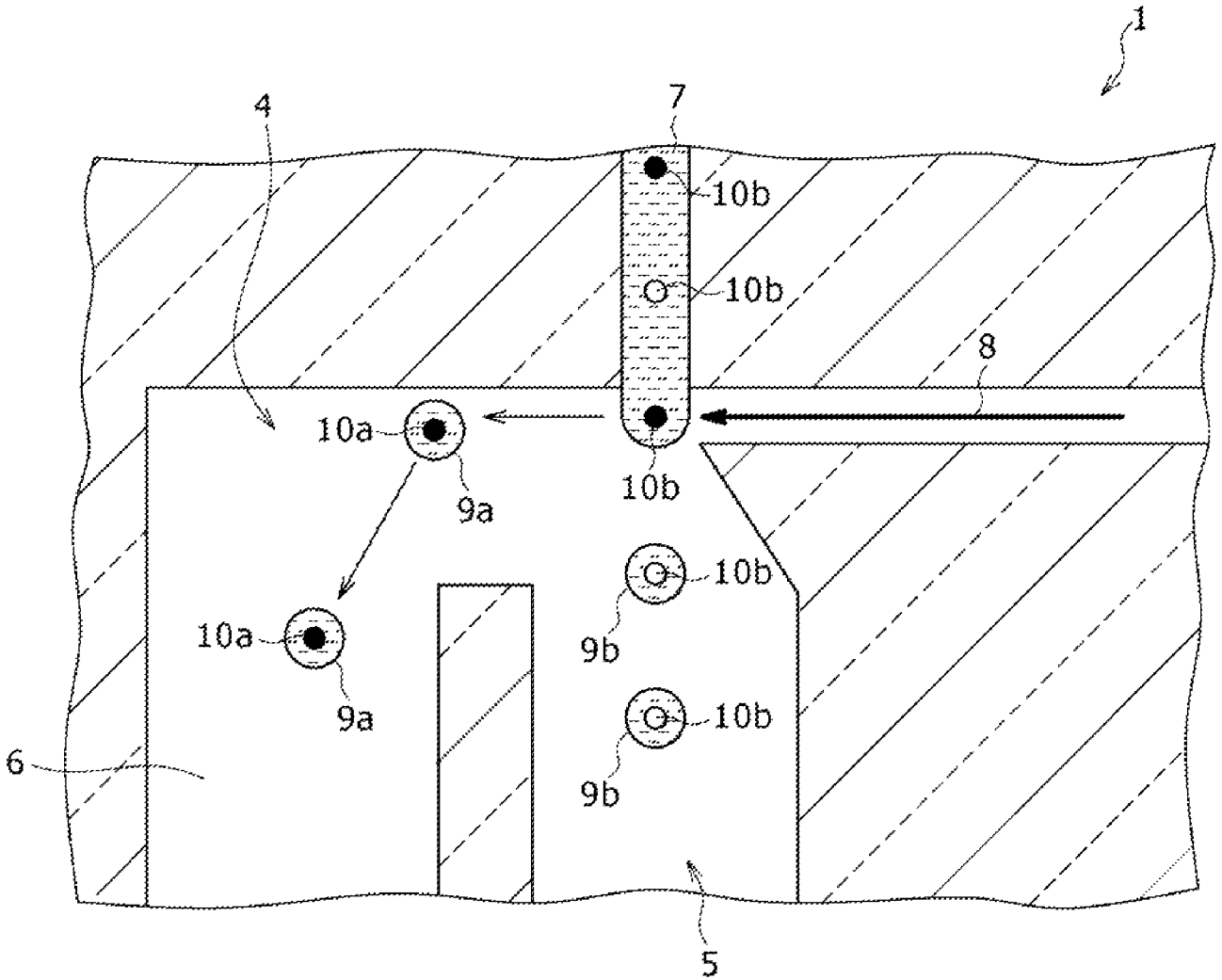
FIG. 2 is a sectional view illustrating schematically a method of sorting micro-particles by use of the micro-fluidic chip shown in FIG. 1.

Now, the operation of the micro-fluidic chip 1 in this embodiment will be described below, taking as an example the case where the micro-fluidic chip is used in the state of being mounted on a micro-particle sorting device. FIG. 2 is a sectional view illustrating schematically the method of sorting micro-particles by use of the micro-fluidic chip 1 in this embodiment. Incidentally, FIG. 2 shows a section perpendicular to the thickness direction of the micro-fluidic chip 1.

The micro-particle sorting device on which to mount the micro-fluidic chip 1 in this embodiment may be required to include at least a sample liquid supply section for introducing a sample liquid into the sample liquid introducing channel 21, a sheath liquid supply section for introducing a sheath liquid into the sheath liquid introducing channel 22, a gas supply section capable of introducing a gas into the gas channel 3 in predetermined conditions, and a detection section for detecting the micro-particles flowing in the liquid channel 2.

In the case of mounting the micro-fluidic chip 1 on the fine particulate sorting apparatus and collecting the desired micro-particles 10*a*, to be collected, from the sample liquid containing a plurality of kinds of micro-particles 10*a*, 10*b*, first, the sample liquid introducing channel 21 and the sheath liquid introducing channel 22 are connected to liquid feed pumps provided in the sample liquid supply section and the sheath liquid supply section, respectively. Through the liquid feed pumps, the sample liquid is supplied into the sample liquid introducing channel 21, and the sheath liquid into the sheath liquid introducing channel 22.

This results in that the sample liquid is peripherally surrounded by the sheath liquid and a laminar flow with a predetermined width is formed in the narrow-down section 23. In this case, by generating a slight pressure difference between the sample liquid and the sheath liquid, the plurality of kinds of micro-particles 10*a* and 10*b* contained in the sample liquid can be aligned substantially in a row.

Next, at the detection section, each of the micro-particles 10*a* and 10*b* introduced into the liquid channel 2 is detected and it is discriminated whether or not the micro-particle is the desired micro-particle to be collected. The method for discrimination is not particularly limited, and any of the methods utilized in micro-fluidic chip-based micro-particle analyzing systems according to the related art can be adopted. For example, when the laminar flow passing through the liquid channel 2 is irradiated with, laser light serving as excitation light, the micro-particles 10*a* and 10*b* pass across the laser light one by one. In this instance, the fluorescence and/or scattered light generated from each of the micro-particles through excitation by the laser light is detected, whereby the kind or the like of each micro-particle can be discriminated.

Subsequently, as shown in FIG. 2, based on the results of discrimination at the detection section, the micro-particles 10*a* and the micro-particles 10*b* in the laminar flow 7 are each guided into the branch zone 6 or the branch zone 5. For instance, in the case where the branch zone 6 is the collected liquid reservoir section for reserving the micro-particles 10*a* to be collected and where the branch zone 5 is the waste liquid reservoir section for reserving the waste liquid containing the other micro-particles 10*b*, air or an inert gas such as carbon dioxide and nitrogen is jetted from the gas channel 3, at a predetermined flow velocity and a predetermined flow rate, when the micro-particle 10*a* to be collected is ejected. As a result, a droplet 9*a* containing the micro-particle 10*a* to be collected is guided by the gas jetted from, the gas channel 3 and is caused to move in the cavity 4 toward the branch zone 6.

On the other hand, when the micro-particle 10*b* not to be collected is ejected or when a droplet not containing any micro-particle is ejected, the gas jetting from the gas channel 3 is not conducted. As a result, a droplet 9*b* containing the micro-particle 10*b* not to be collected and the droplet not containing any micro-particle are each caused to move in the cavity 4 toward the branch zone 5. Thus, in the sorting method using the micro-fluidic chip 1 in this embodiment, the moving direction, of the micro-particles 10*a*, 10*b* can be controlled by the presence/absence of the gas jet from the gas channel 3.

Incidentally, the timing for jetting the gas from the gas channel 3 can be calculated, for example, from the distance from the detection section to the downstream end part of the liquid channel 2 (the droplet ejecting part) and the flow velocity of the liquid flowing through the liquid channel 2 (the laminar flow 7). While the branch zone 6 functions as the collected liquid reservoir section and the gas is jetted to the droplets containing the micro-particles 10*a* to be collected in this embodiment, the present embodiment is not limited to this configuration, and a configuration may be adopted in which the branch zone 5 functions as the collected liquid reservoir section. In the latter case, when the droplet containing the micro-particle 10*a* to be collected is ejected, the gas jetting from the gas channel 3 is not conducted, and the gas is jetted when the other droplets are ejected. This method is effective, for example, where the proportion of the micro-particles to be collected contained in the sample liquid is high.

As above-mentioned, in the micro-fluidic chip 1 according to this embodiment, the gas is jetted to the desired micro-particles 10*a* to be collected, whereby the moving direction of the micro-particles 10*a* is controlled. Therefore, damage to the micro-particles can be lessened, as compared to the case of a related-art micro-fluidic chip in which the moving direction of micro-particles is controlled by an electric field or a magnetic field.

In addition, while the micro-particle-containing droplets have to be electrically charged at high accuracy in the case of controlling the moving direction of the droplets by an electric field, in the micro-fluidic chip 1 according to this embodiment it is unnecessary to subject the droplets to an electrically charging treatment, or the like. In the micro-fluidic chip 1 in this embodiment, therefore, the configuration can be simplified and, further, the moving direction of the micro-particles can be controlled speedily and accurately, notwithstanding the simple configuration. As a result, sorting at lower cost and at higher speed and accuracy can be realized, as compared with the cases of micro-fluidic chips according to the related art.

Furthermore, in the micro-fluidic chip 1 according to this embodiment, the micro-particles 10*a* can be sorted and collected in the closed inside space of the micro-fluidic chip 1, so that there is no fear of mutual contamination of the micro-particles or infection of the measuring person with a disease due to a bio-hazard materials containing aerosol or the like.

Therefore, even where the micro-particles are biomaterial, the intended operation can be carried out safely and hygienically.

Incidentally, while the gas channel 3 is formed in the inside of micro-fluidic chip body and the gas is jetted from the gas channel 3 toward the micro-particles in the micro-fluidic chip 1 according to this embodiment, the present embodiment is not limited to this configuration, and a fine tube can be used in place of the gas channel 3. This ensures that the jetting conditions such as the position of jetting the gas toward the micro-particle-containing liquid or droplets can be regulated more readily.

Besides, while the liquid channel 2 and the gas channel 3 are arranged in such positions that their flow directions intersect orthogonally in the micro-fluidic chip shown in FIG. 1, the present embodiment is not limited to this arrangement. Specifically, the angle at which the flow directions intersect can be arbitrarily set according to the direction in which the droplets are desired to move.

In the micro-fluidic chip 1 in this embodiment, further, the branch zone 6 for reserving the collected liquid may be filled with an anti-drying gel. The number (proportion) of rare cells such as stem cells which are to be sorted is extremely small, in the range from one cell per several tens of thousands of cells to one cell per several millions of cells. Therefore, even if sorted into the branch zone 6, the cells may be dried to death in the case where the measurement and recover time is long. In addition, where the branch zone 6 is filled with physiological saline for preventing the cells from being dried, the number of the cells contained in the collected liquid is so small that if is difficult to pick up the cells from the liquid. Furthermore, such rare cells have the problem that when the sorting speed is raised, the cells would be damaged through collision against side walls of the channel or the sorting zone.

In view of this, the branch zone 6 for reserving the collected liquid is preferably filled with an anti-drying gel, whereby it is possible to prevent the sorted cells from being dried and to prevent the cells from colliding against the side wails of the branch zone or the like. In addition, where the sorted cells are recovered together with the gel after the sorting operation by opening an upper surface of the collected liquid reserving branch zone 6, the sorted cells can be collected assuredly and readily. In this case, over the period from the filling of the branch zone 6 with the gel to the recovery of the sorted cells together with the gel, the aperture in the upper surface of the branch zone 6 may be kept closed with a film or the like, whereby drying of the gel can be prevented.

Such an anti-drying gel can be appropriately selected according to the kind and characteristics of the cells to be collected. For example, an agar medium, gels ordinarily used for cells, and the like, can be used as the anti-drying gel.

In addition, where the micro-particles such as cells are preliminarily modified with a magnetic antibody or the like, the micro-particles 10*a* to be collected which are sorted into the branch zone 6 can be collected into a specified position by utilizing a magnetic force or the like. This makes it possible to efficiently collect the desired micro-particles to be collected, even where the number of the desired micro-particles is extremely small.

Figure 3:
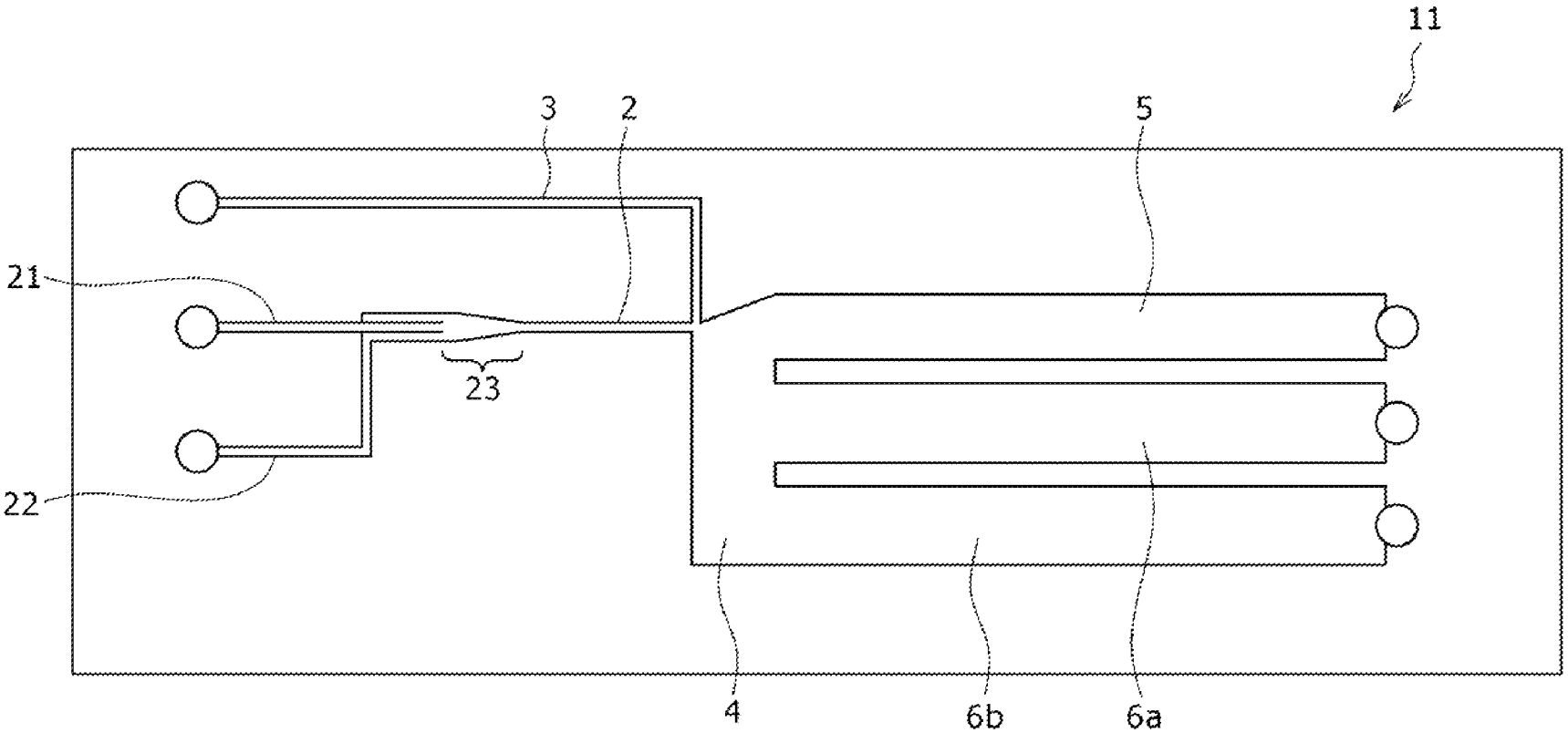
FIG. 3 is a plan view showing the configuration of a micro-fluidic chip according to a modification of the first embodiment.

On the other hand, while only two branch zones are provided in the micro-fluidic chip 1 according to this embodiment, the present embodiment is not limited to this configuration, and three or more branch zones may be provided. For instance, where a plurality of kinds of micro-particles are to be collected fractionally, a corresponding number of branch zones for reserving the collected liquids are provided, whereby the micro-particles to be collected can be sorted and collected on a kind basis. FIG. 3 is a plan view showing the configuration of a micro-fluidic chip according to a modification of the present embodiment. Incidentally, in FIG. 3, the same component elements as those of the micro-fluidic chip 1 shown in FIG. 1 above are denoted by the same symbols as used above, and detailed descriptions of these component elements are omitted here.

As shown in FIG. 3, in the micro-fluidic chip 11 in this modification, three branch zones 5, 6*a* and 6*b* are provided in connection with a cavity 4. Of these branch zones 5, 6*a* and 6*b*, the branch zone 5 formed coaxially with the flow direction of a liquid channel 2 functions as a waste liquid reservoir section, and the branch zones 6*a* and 6*b* which are formed at positions farther from a downstream end part (gas ejection port) of a gas channel 3 than the branch zone 5 is function as collected liquid reservoir sections.

In the micro-fluidic chip 11, the flow rate or pressure of the gas jetted from the gas channel 3 is regulated on the results of discrimination conducted at a detection section, whereby the moving direction of the micro-particles can be controlled. Specifically, in the case of guiding the micro-particles into the branch zone 6*a*, it suffices to reduce the flow rate or pressure of the gas jetted from the gas channel 3, as compared with the case of guiding the micro-particles into the branch zone 6*b*. This ensures that the micro-particles can be sorted on a kind basis. Incidentally, the configurations and effects other than the just-mentioned of the micro-fluidic chip 11 in this embodiment are the same as those of the micro-fluidic chip 1 in the first embodiment described above.

Figure 4:
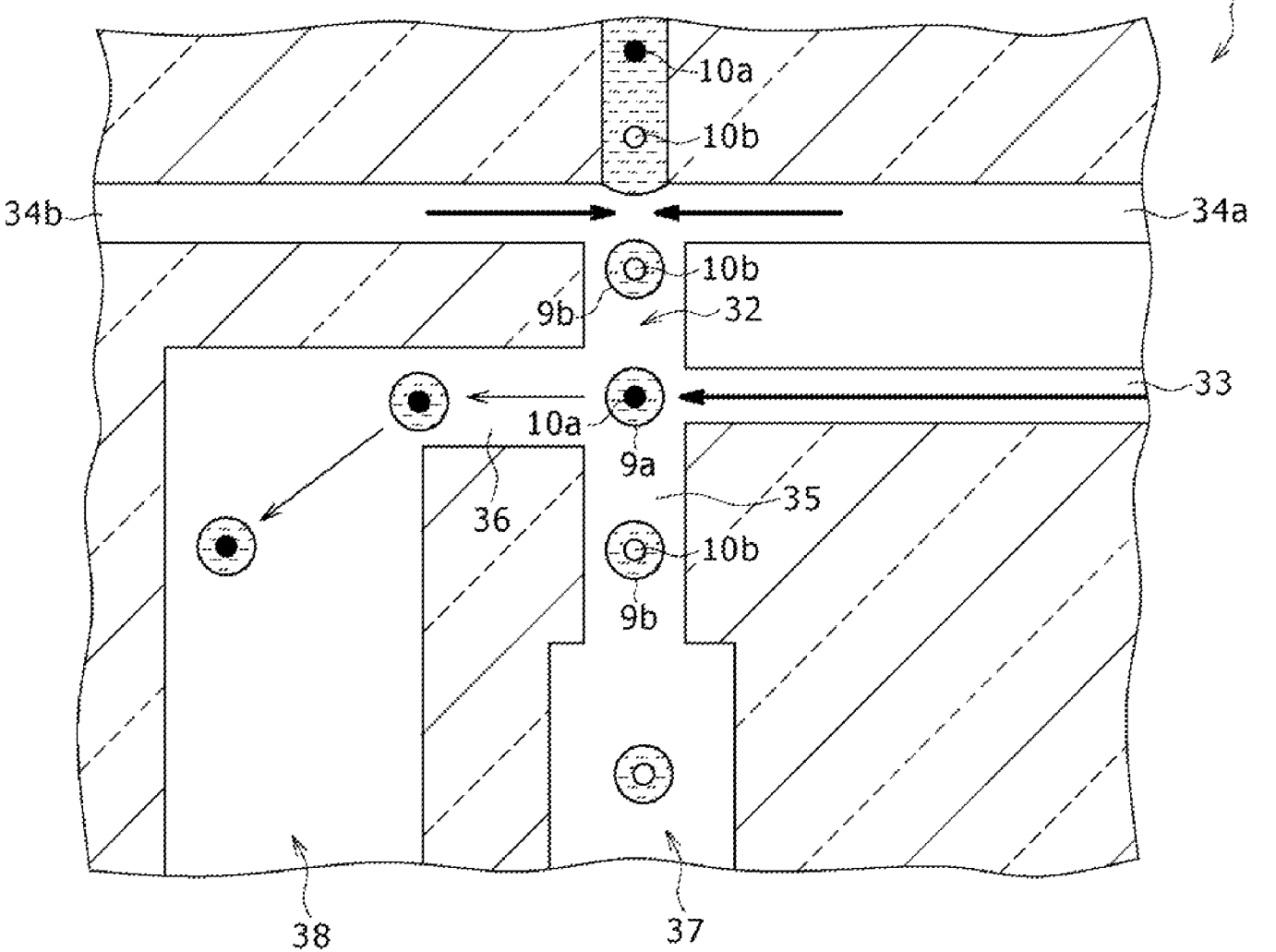
FIG. 4 is an enlarged sectional view showing a part of the configuration of a micro-fluidic chip according to a second embodiment.

Now, a micro-fluidic chip according to a second embodiment will be described below. FIG. 4 is an enlarged sectional view showing a part of the micro-fluidic chip in this embodiment. Incidentally, in FIG. 4, the same component elements as those of the micro-fluidic chip 1 according to the first embodiment above are denoted by the same symbols as used above, and detailed description of these component elements are omitted here. While the droplets are formed at the time of ejection of the liquid to a downstream end part of the liquid channel 2, or into the cavity 4, in the micro-fluidic chip 1 in the first embodiment above, the present embodiment is not limited to this configuration, and the droplets may be formed in the liquid channel 2.

As shown in FIG. 4, in the micro-fluidic chip 31 according to this embodiment, a pair of gas introducing sections 34*a* and 34*b* are provided between a detection section and the downstream end part of the liquid channel 32. Besides, in this micro-fluidic chip 31, a gas is introduced from the gas introducing sections 34*a* and 34*b* at a predetermined timing, whereby a laminar flow composed of a sample liquid and a sheath liquid flowing in the periphery of the sample liquid is split into droplets. As a result, droplets containing a micro-particle 10*a* or a micro-particle 10*b* are formed in the liquid channel 32.

Incidentally, while the gas introducing sections 34*a* and 34*b* are provided on both lateral sides of the liquid channel 32 in FIG. 4, the present embodiment is not limited to this configuration, insofar as at least one gas introducing section is provided on the lateral side of the liquid channel 32.

Like in the first embodiment described above, the moving direction of each of the droplets 9*a* and 9*b* containing the micro-particles 10*a* and 10*b* respectively is controlled by the gas jetted from the gas channel 33 based on the results of discrimination conducted in the detection section. Specifically, two branch channels 35 and 36 communicating with the liquid channel 32 are provided, a waste liquid reservoir zone 37 is formed at an end part of the branch channel 35 of which the flow direction is coaxial with that of the liquid channel 32, and a collected liquid reservoir zone 38 is formed in connection with the branch channel 36 of which the flow direction is coaxial with that of the gas channel 33.

When the droplet 9*a* containing the micro-particle 10*a* to be collected is ejected from the liquid channel 32, the gas such as air or an inert gas, e.g., carbon dioxide or nitrogen, is jetted from the gas channel 33, whereby the droplet 9*a* is guided into the branch channel 36 communicating with the collected liquid reservoir zone 38. On the other hand, when the droplet 9*b* containing the micro-particle 10*b* not to be collected is ejected from the end part of the liquid channel 32, the gas jetting from the gas channel 33 is not conducted, so that the droplet 9*b* is guided into the branch channel 35 communicating with the waste liquid reservoir zone 37.

Incidentally, while the droplets 9*a*, 9*b* containing the micro-particles are guided into the branch channels 35, 36 in the micro-fluidic chip 31 in this embodiment, the present embodiment is not limited to this configuration. Another configuration may be adopted in which, like in the micro-fluidic chip 1 shown in FIG. 1, a cavity is provided at a downstream end part of the liquid channel 32, and the droplets are moved into predetermined branch zones while being guided by the gas jetted from the gas channel. Besides, like in the micro-fluidic chip according to the modification of the first embodiment described above, three or more branch channels may be provided, and the strength or direction of the gas jet may be regulated, whereby the moving distance or moving direction or the like of each droplet can be controlled.

In the micro-fluidic chip 31 according to this embodiment, the micro-particle-containing droplets are thus formed in the course of flowing of the micro-particle-containing liquid through the liquid channel 32, whereby the micro-particle-containing liquid can be split at an arbitrary timing, to form the droplets in the liquid channel 32. This ensures that the number of micro-particles contained in each droplet can be set arbitrarily. Furthermore, since the liquid is forcibly split into droplets by the introduction of the gas, stable droplets can be formed.

Incidentally, the configurations and effects other than the above-mentioned of the micro-fluidic chip 31 in this embodiment are the same as those of the micro-fluidic chip in the first embodiment described above.

In addition, the micro-fluidic chip according to the present embodiment is applicable at the time of collection of bio-related micro-particles such as biopolymer material, e.g., cells or microorganisms, and various synthetic micro-particles, and the like. Examples of the cells include animal cells, such as blood cells, and plant cells. Besides, examples of the microorganisms include bacteria such as colibacillus, etc., viruses such as tobacco mosaic virus, etc., and fungi such as yeast. Further, examples of the biopolymer material include those constituting various cells, such as chromosome, liposome, mitochondria, and organelles.

On the other hand, the synthetic micro-particles include micro-particles formed of organic polymer material such as polystyrene, styrene-divinylbenzene, polymethyl methacrylate, etc., micro-particles formed of inorganic material such as glass, silica, magnetic material, etc., and micro-particles formed of metallic material such as gold colloid, aluminum, etc. Incidentally, while the micro-particles are in general spherical in shape, the method of collecting micro-particles according to the present embodiment is applicable also to non-spherical micro-particles, and the micro-particles are not particularly limited in size or mass.

Furthermore, since the micro-fluidic chip according to the present embodiment enables sorting in a closed space, the micro-fluidic chip is particularly preferable for cell sorting in the field of clinical regenerative medicine.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A micro-fluidic chip comprising:

a channel configured to allow flow of a liquid containing micro-particles therethrough;

a cavity zone into which droplets are introduced from said channel, said droplets including a first type of droplet and a second type of droplet;

a first branch zone configured to store said first type of droplet;

a second branch zone configured to store said second type of droplet; and a gas jetting section configured to jet a gas toward said first type of droplet ejected from said channel, said gas moving said first type of droplet to said first branch zone.

2. The micro-fluidic chip according to claim 1, wherein the first type of droplet is to be collected and the second type of droplet is waste.

3. The micro-fluidic chip according to claim 1, comprising a gas introducing section which joins said channel from at least one lateral side and through which a gas is introduced into said channel.

4. The micro-fluidic chip according to claim 1, wherein the moving direction of said droplets is controlled by regulating the flow rate and/or pressure of said gas.

5. A micro-particle sorting device on which a micro-fluidic chip is mounted, said micro-fluidic chip comprising:

a channel configured to allow flow of a liquid containing micro-particles therethrough;

a cavity zone into which droplets are introduced from said channel, said droplets including a first type of droplet and a second type of droplet;

a first branch zone configured to store said first type of droplet;

a second branch zone configured to store said second type of droplet; and a gas jetting section configured to jet a gas toward said first type of droplet ejected from said channel, said gas moving said first type of droplet to said first branch zone.

6. The micro-particle sorting device according to claim 5, wherein the first type of droplet is to be collected and the second type of droplet is waste.

7. A droplet sorting method comprising:

(a) enabling liquid that contains micro-particles to flow through a channel;

(b) determining if a droplet of the liquid is a first type of droplet or a second type of droplet;

(c) if the droplet is a first type of droplet, jetting a gas toward said droplet to move said droplet to a first branch zone which stores said droplet; and (d) if said droplet is a second type of droplet, enabling the droplet to flow to a second branch zone without jetting gas toward said droplet, said second branch zone storing said droplet.

8. The droplet sorting according to claim 7, wherein the first type of droplet is to be collected and the second type of droplet is waste.

* * * * *